US005181897A

United States Patent [19]

Agan

[11] Patent Number: 5,181,897

[45] Date of Patent: Jan. 26, 1993

[54] EXERCISE APPARATUS FOR USE FOR DOING INCLINED PUSH-UP

[76] Inventor: George E. Agan, 2605 Southside Dr., Brownwood, Tex. 76801

[21] Appl. No.: 798,836

[22] Filed: Nov. 25, 1991

Related U.S. Application Data

[63] Continuation of Ser. No. 592,965, Oct. 4, 1990, abandoned.

[51] Int. Cl.[5] ..... A63B 23/12

[52] U.S. Cl. ..... 482/141; 482/142

[58] Field of Search ..... 272/62-68, 272/93, 111, 126, 144; 425/458; 15/235.7; 482/38-50, 148, 25, 34, 131, 141, 142

[56] References Cited

U.S. PATENT DOCUMENTS

| | | | |
|---|---|---|---|
| 2,551,105 | 5/1951 | Eiden et al. | 15/235.4 |
| 2,811,767 | 11/1957 | Dufford | 425/458 X |
| 4,351,525 | 9/1982 | Rozenblad | 272/93 |
| 4,358,106 | 11/1982 | Shadford | 272/93 |
| 4,406,450 | 9/1983 | Regan | 272/63 |
| 4,621,806 | 11/1986 | Wheeler | 272/93 |
| 4,854,573 | 8/1989 | Johannson et al. | 272/93 |

FOREIGN PATENT DOCUMENTS

| | | | |
|---|---|---|---|
| 214712 | 11/1956 | Australia | 15/235.7 |
| 202078 | 8/1907 | Fed. Rep. of Germany | 15/235.7 |

*Primary Examiner*—V. Millin
*Assistant Examiner*—J. Doyle

[57] ABSTRACT

A tool for use for performing inclined push-ups with a hand grip (1) to hold the tool and support arms of sufficient length to hold an exerciser away from the object a persons is exercising against and of sufficient strength to support the weight of the user. The support arms are attached to a support bracket (3) which is used to anchor the exercise apparatus in place, and should be of sufficient size as to provide a secure anchor. Attached to the support bracket are anti-slip tabs that insure against the exercise apparatus sliding, while the person is exercising.

6 Claims, 2 Drawing Sheets

EXERCISE APPARATUS FOR USE FOR DOING INCLINED PUSH-UP

This application is a continuation of application Ser. No. 07/592,965, filed Oct. 4, 1990, now abandoned.

BACKGROUND OF THE INVENTION

1. Field of the Invention

This invention relates to exercise, especially to exercise that uses the body as the resistance means.

2. Description of the Prior Art

Many people who exercise use their bodies as the resistance in performing an exercise regimen.

Heretofore a number of ways and devices have been implemented for performing exercises using the body's weight as resistance.

One such way is the use of the military push-up. Users find this type of exercise limiting because the body cannot move through a full range of motion while exercising.

Another way of exercising, using the body as the resistance is to perform the push-up while grasping small handles that elevate the body away from the ground far enough that a full range of motion can be obtained while exercising, which is better than the military push-up. Users find this exercise limiting because, even though full extension can be obtained, resistance cannot be modified to allow the exerciser to benefit from a greater number of exercise repetitions, which is vital in developing strength and muscle mass, as well as local muscle endurance.

SUMMARY OF THE INVENTION

The invention is directed to an exercise apparatus or tool that will allow the user to both perform a full range of movement while exercising and be able to adjust the resistance the body will provide, while performing that exercise.

The exercise apparatus of the invention provides support for the palms while grasping, and provides the joints with proper alignment necessary for maximizing the number of exercise repetitions possible without creating trauma to the joints.

DESCRIPTION OF THE PREFERRED EMBODIMENT

Figure 1:
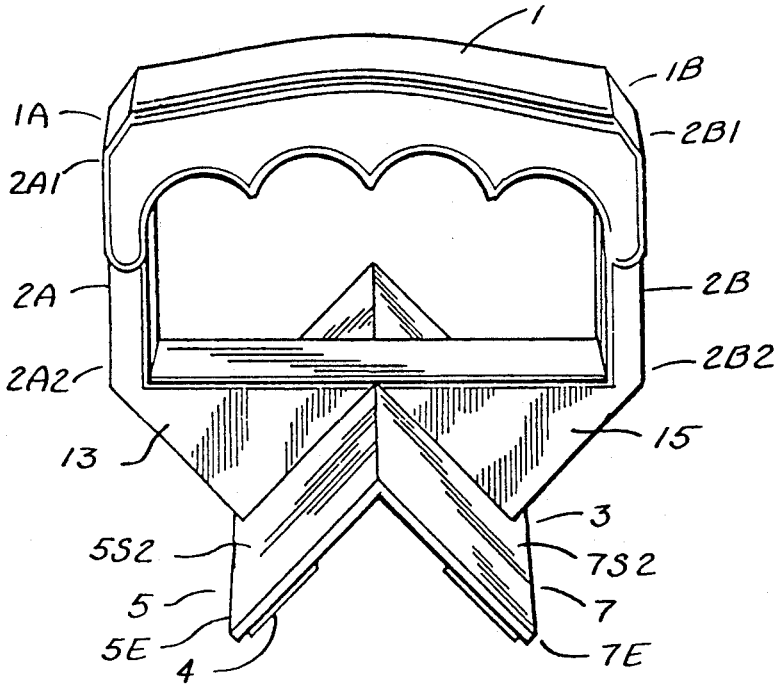
FIG. 1 shows a perspective side view of one of the two handles or exercise apparatus according to the invention.
Figure 2:
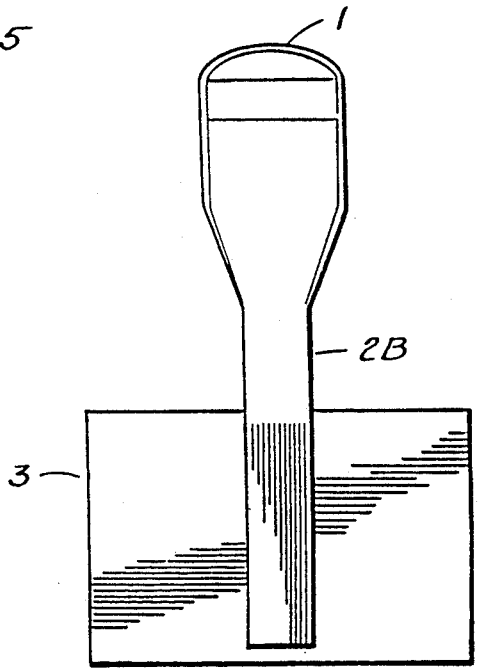
FIG. 2 shows an end view of the handle or exercise apparatus of FIG. 1.
Figure 3:
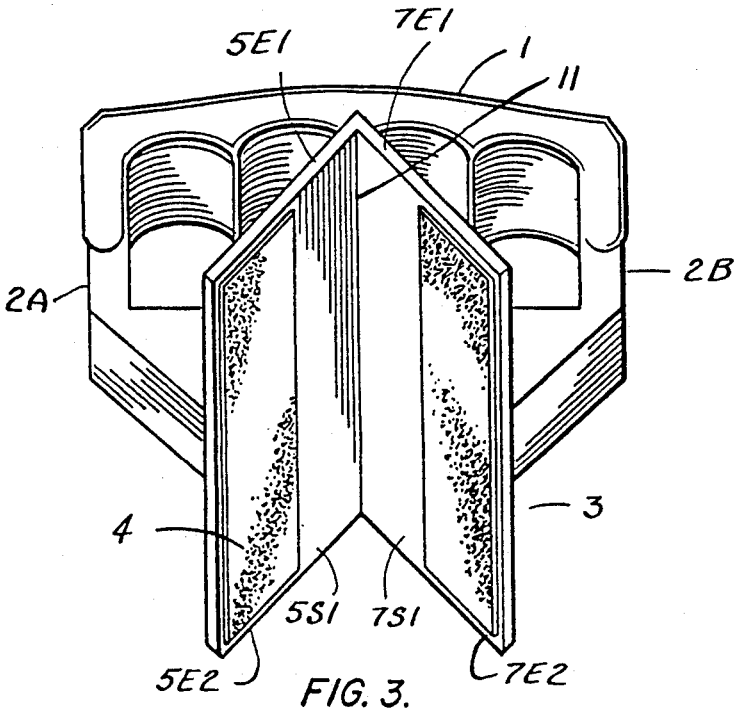
FIG. 3 shows a perspective bottom view of the exercise apparatus of FIG. 1.
Figure 4:
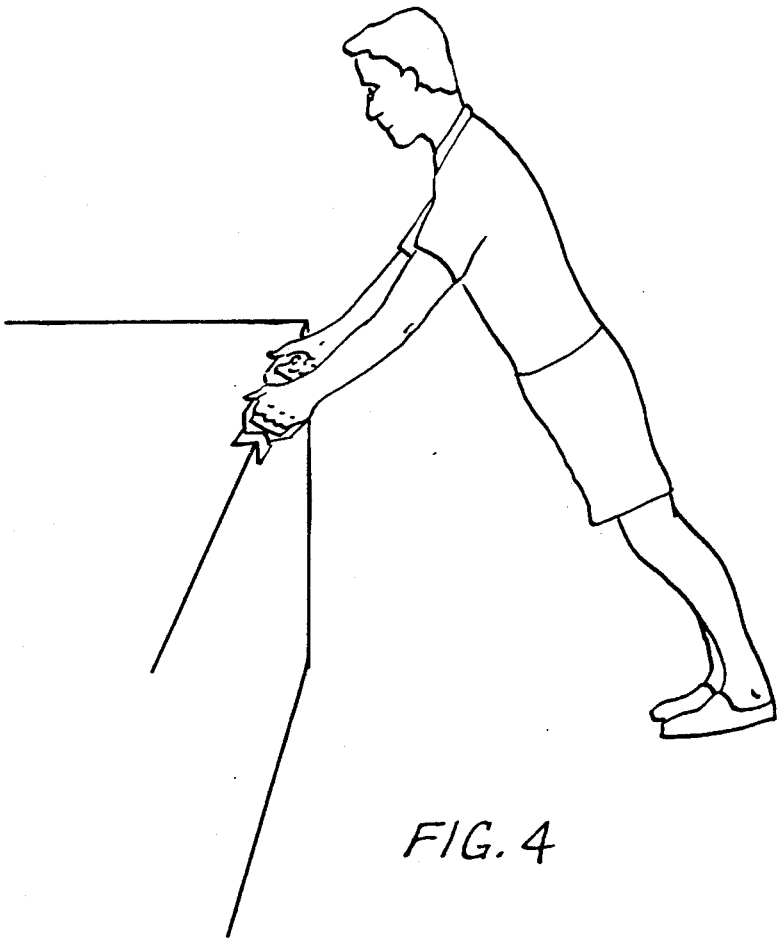
FIG. 4 shows a person performing an exercise with the two exercise apparatus of the invention in the starting position of an inclined push-up.
Figure 5:
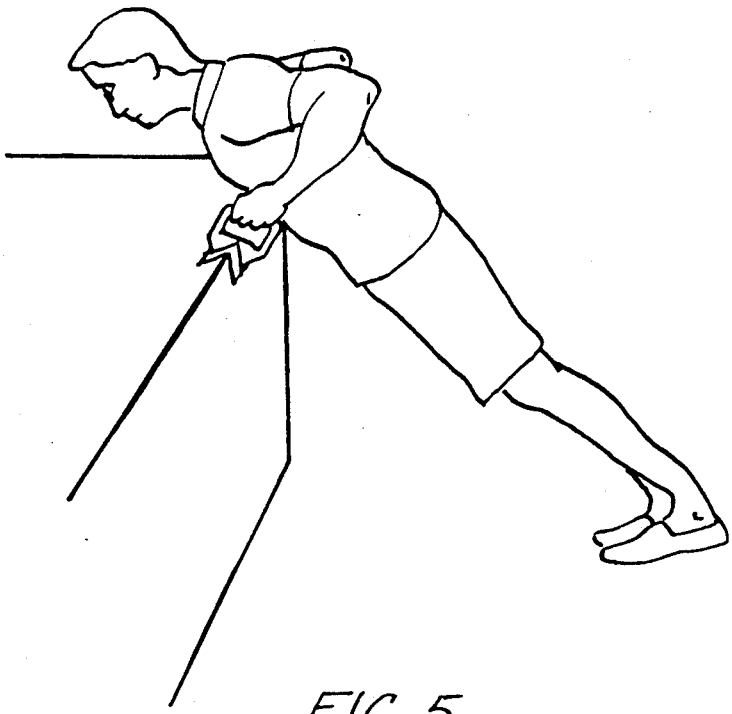
FIG. 5 shows a person performing an exercise with the two exercise apparatus in the fully extended position of an inclined push-up.

FIG. 1 shows one of two handles or exercise apparatus according to the preferred embodiment of the invention. The handle or exercise apparatus comprises a hand grip 1 which is preferably made of strong plastic which is molded to the support arms 2A and 2B which are preferably made of plastic and are molded to the support bracket 3 which is also, preferably made of plastic. FIG. 1 shows anti-slip tabs 4 which are attached to support bracket 3 and provides assurance against slipping while exercising. FIG. 4 shows a person 6 using the two exercise apparatus at the starting position of an inclined push-up. FIG. 5 shows a person 6 using the two exercise apparatus in the fully extended position of an inclined push-up.

The bracket or engaging means 3 comprises two plate members 5 and 7 each of which have first and second sides 5S1, 5S2, and 7S1, 7S2, respectively. Each of the members 5 and 7 also have first and second edges 5E1, 5E2, and 7E1, 7E2 respectively and an end portion 5E and 7E respectively extending between the two edges. The two members 5 and 7 are coupled together at 9 and the end portions 5E and 7E are spaced from each other with the sides 5S1 and 7S1 defining an angle less than 180 degrees. The apex 11 of the angle has a given length and extends generally transverse to the edges.

The hand grip 1 has first and second ends 1A and 1B which are coupled to the ends 2A1 and 2B1 of the arms 2A and 2B respectively. The other ends 2A2 and 2B2 of the arms 2A and 2B are coupled to triangular support members 13 and 15 which in turn are coupled to the sides 5S2 and 7S2 of members 5 and 7.

The anti-slip members 4 are secured to the sides 5S1 and 5S2 of members 5 and 7.

While the above description contains specificities, the reader should not construe these as limitations on the scope of the invention, but merely as exemplifications of preferred embodiments thereof. Those skilled in the art will envision many other possible variations within its scope. For example skilled artisans will readily be able to change the dimensions and shape of the various embodiments. They will also be able to make the device of alternative materials such as metals or wood. They may make adjustments on the angle of the handgrip in relationship to the support bracket. Also, one skilled in the art might make the handgrip pivot to accommodate the hand more directly no matter what the angle of incline. They may also use a different material for the handgrips making them more comfortable or they may change the anti-slip tabs to a different material or not use them at all.

The scope of the invention is set forth by the appended claims and their equivalents and is not limited by the examples which have been given.

I claim:

1. An exercise apparatus for allowing a person to perform push-ups, comprising:

engaging means comprising two members, each of which have first and second sides, each of said members having two spaced apart edges and an end portion extending between said two edges, said two members being coupled together such that said end portions of said two members are spaced from each other with said first sides of said two members defining an angle less than 180 degrees between said end portions for engaging a non-planar support surface, the apex of said angle being located between said two end portions and having a given length extending generally transverse to said edges, at least one arm having first and second ends with said first end being coupled to said second side of one of said members, and a hand grip having first and second ends defining a given length with said first end of said hand grip being coupled to said second end of said arm such that said hand grip is transverse to said arm, said length of said hand grip being transverse to said length of said apex of said angle.

2. The exercise apparatus of claim 1, wherein:

said arm is defined as a first arm, a second arm having first and second ends with said first end of said second arm being coupled to said second side of said member, and said second end of said second arm being coupled to said second end of said hand grip.

3. The exercise apparatus of claim 2, comprising:

first and second support means coupling said first ends of said first and second arms to said second sides of said first and second members respectively, said first and second support means each being generally triangular in shape for supporting said hand grip while a person performs push-ups while gripping said hand grip.

4. The exercise apparatus of claim 3, wherein:

said first sides of said two members have anti-slip members to enable gripping of a non-planar surface.

5. The exercise apparatus of claim 3, wherein:

said first sides of said two members have anti-slip members to enable gripping of a non-planar surface.

6. A method of performing push-ups by a person with two exercise apparatus of the type comprising engaging means comprising two members, each of which have first and second sides, each of said members having two spaced apart edges and an end portion extending between said two edges, said two members being coupled together such that said end portions of said two members are spaced from each other with said first sides of said two members defining an angle less than 180 degrees between said end portions for engaging a non-planar support surface, the apex of said angle being located between said two end portions and having a given length extending generally transverse to said edges, at least one arm having first and second ends with said first end being coupled to said second side of one of said members, and a hand grip having first and second ends defining a given length with said first end of said hand grip being coupled to said second end of said arm such that said hand grip is transverse to said arm, said length of said hand grip being transverse to said length of said apex of said angle, said method comprising the steps of:

gripping said hand grips of said two apparatus, engaging a non-planar support surface with said first sides of said two members, and performing push-ups.

* * * * *